US010745193B2

(12) United States Patent
Chang et al.

(10) Patent No.: US 10,745,193 B2
(45) Date of Patent: Aug. 18, 2020

(54) EQUIPMENT MOVING DEVICE

(71) Applicant: HONGFUJIN PRECISION ELECTRONICS (TIANJIN) CO., LTD., Tianjin (CN)

(72) Inventors: Chih-Hung Chang, New Taipei (TW); Yen-Chun Fu, New Taipei (TW); Tze-Chern Mao, New Taipei (TW)

(73) Assignee: HONGFUJIN PRECISION ELECTRONICS (TIANJIN) CO., LTD., Tianjin (CN)

( * ) Notice: Subject to any disclaimer, the term of this patent is extended or adjusted under 35 U.S.C. 154(b) by 67 days.

(21) Appl. No.: 16/195,301

(22) Filed: Nov. 19, 2018

(65) Prior Publication Data

US 2020/0071070 A1 Mar. 5, 2020

(30) Foreign Application Priority Data

Aug. 30, 2018 (CN) ..... 2018 1 1006335

(51) Int. Cl.
*B66F 3/44* (2006.01)
*B65D 88/54* (2006.01)
*B65D 88/12* (2006.01)

(52) U.S. Cl.
CPC ..... *B65D 88/546* (2013.01); *B65D 88/12* (2013.01)

(58) Field of Classification Search
CPC ..... B66F 1/00; B66F 1/06; B66F 3/00; B66F 3/14; B66F 3/16; B66F 3/18; B66F 3/28; B66F 5/00
See application file for complete search history.

(56) References Cited

U.S. PATENT DOCUMENTS

| | | | | | |
|---|---|---|---|---|---|
| 364,373 | A * | 6/1887 | Reisch | B66F 3/08 | 254/98 |
| 2,465,177 | A * | 3/1949 | Shaffer | B25B 27/16 | 254/100 |
| 4,000,880 | A * | 1/1977 | Graafsma | B66F 3/16 | 254/103 |
| 4,015,825 | A * | 4/1977 | Graafsma | B66F 13/00 | 254/101 |
| 5,118,082 | A * | 6/1992 | Byun | B66F 3/20 | 254/102 |
| 5,421,555 | A * | 6/1995 | Sims | B60D 1/66 | 254/420 |
| 5,664,762 | A * | 9/1997 | Rothbauer | B66F 3/10 | 254/103 |
| 6,910,677 | B1 * | 6/2005 | Miller | B66F 3/12 | 254/103 |
| 2011/0101289 | A1 * | 5/2011 | Lee | E04F 21/22 | 254/103 |

* cited by examiner

*Primary Examiner* — Lee D Wilson
(74) *Attorney, Agent, or Firm* — ScienBiziP, P.C.

(57) ABSTRACT

An equipment moving device for moving equipment in and out of a container includes a base, a cover rotationally coupled to the base, a driving member mounted to an outer side of the cover, a transmission assembly mounted within the base and the cover and coupled to the driving member, and a pushing member. One end of the pushing member is coupled to the transmission assembly, and another end of the pushing member is mounted to the equipment. The driving member causes the transmission assembly to drive the pushing member to move the equipment.

18 Claims, 3 Drawing Sheets

EQUIPMENT MOVING DEVICE

FIELD

The subject matter herein generally relates to moving devices, and more particularly to an equipment moving device for moving equipment in and out of a container.

BACKGROUND

Containers, such as shipping containers, are often required to be equipped with large equipment, such as an air conditioners, for cooling the containers. Such pieces of equipment are generally heavy and large and may be required to be moved in and out of the containers.

BRIEF DESCRIPTION OF THE DRAWINGS

Implementations of the present disclosure will now be described, by way of example only, with reference to the attached figures.

DETAILED DESCRIPTION

Figure 1:
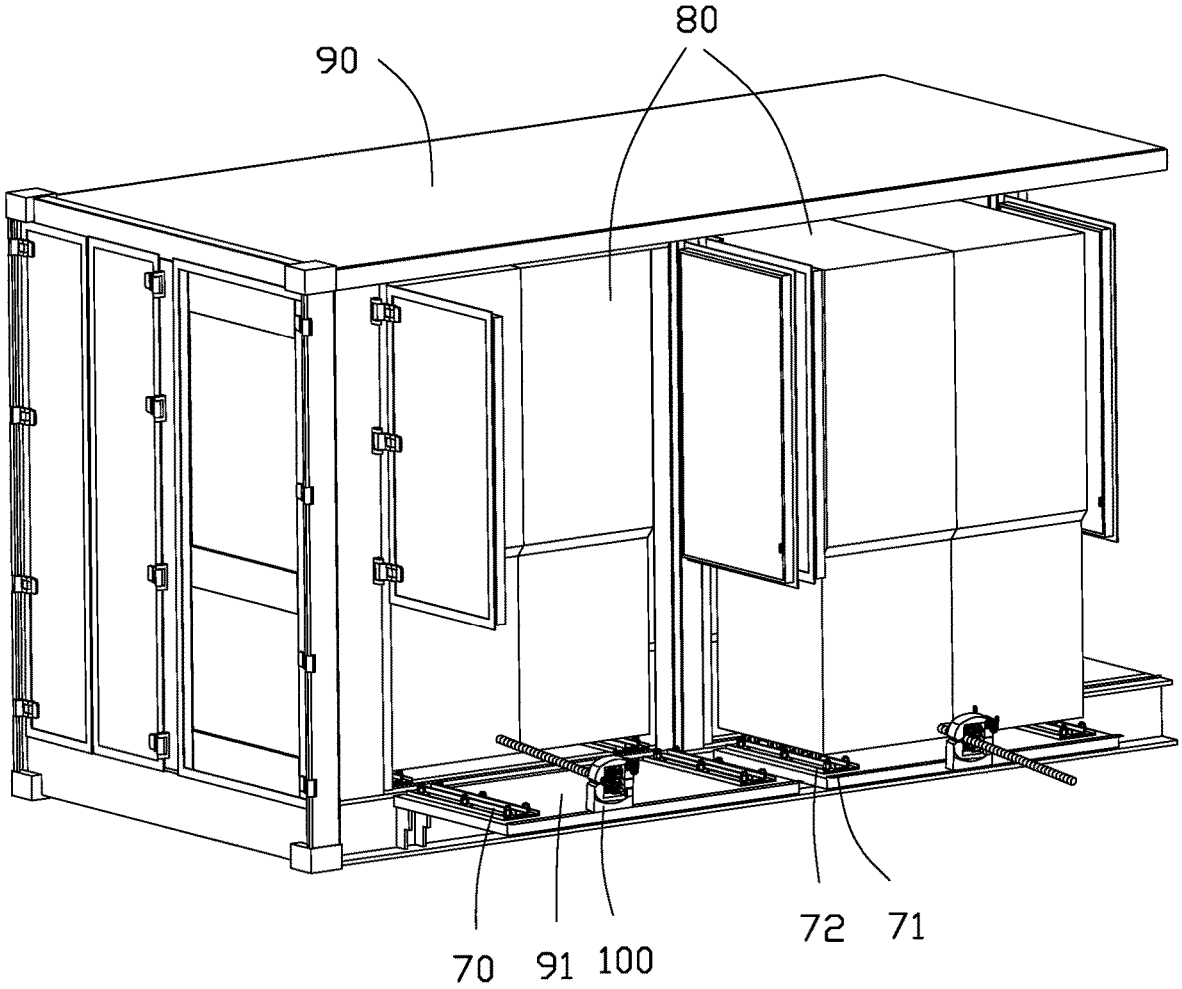
FIG. 1 is an isometric view of a container including an equipment moving device in accordance with an embodiment of the present disclosure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
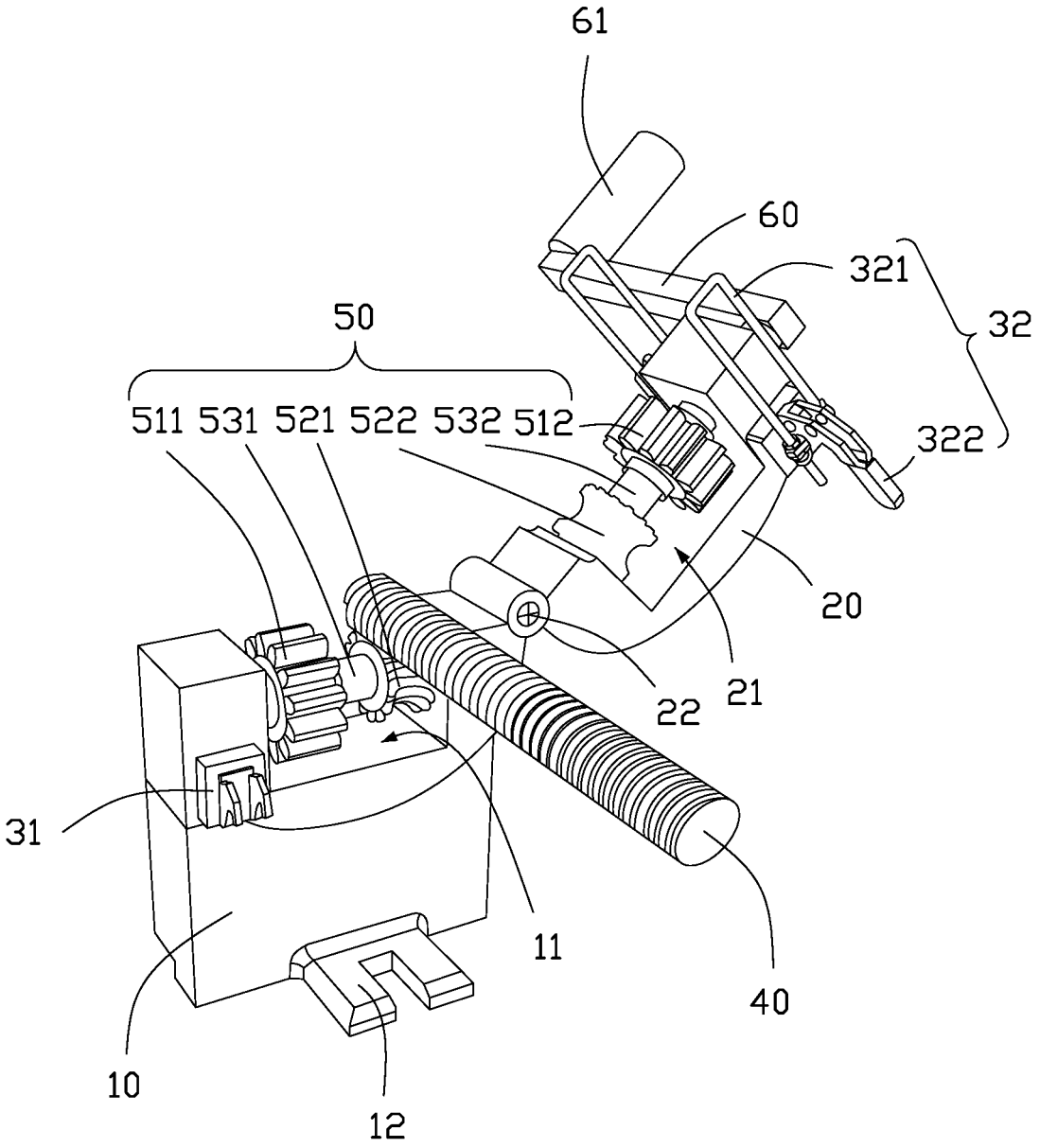
FIG. 2 is an isometric view of the equipment moving device in FIG. 1.
Figure 3:
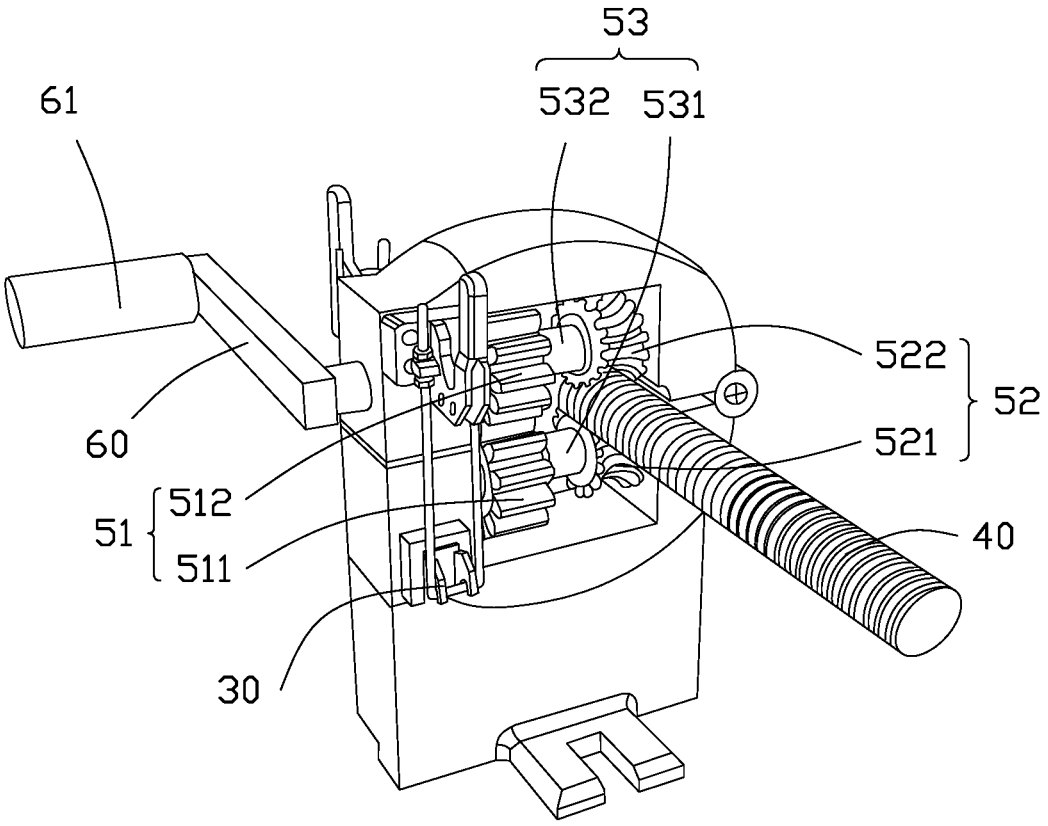
FIG. 3 is an isometric view of the equipment moving device in FIG. 2 showing a cover of the equipment moving device locked to a base of the equipment moving device.

FIGS. 1-3 show an embodiment of an equipment moving device 100 for moving equipment 80 in and out of a container 90. In one embodiment, the equipment 80 may be an air conditioner. The equipment moving device 100 includes a base 10, a cover 20, a locking assembly 30, a pushing member 40, a transmission assembly 50, a driving member 60, and a guide assembly 70. In one embodiment, the driving member 60 is a lever. The base 10 is rotationally coupled to the cover 20 by an operating shaft 22 rotationally coupling an end of the base 10 to an end of the cover 20. The cover 20 is rotatable around the operating shaft 22. When the equipment moving device 100 is closed, the locking assembly 30 locks the base 10 to an opposite end of the cover 20. The transmission assembly 50 is mounted within the base 10 and the cover 20. One end of the pushing member 40 is coupled to the equipment 80. An outer surface of the pushing member 40 includes a plurality of screw threads or gear teeth. In one embodiment, the pushing member 40 is a screw. The driving member 60 is mounted to an outer side of the cover 20 and operationally coupled to the transmission assembly 50. The transmission assembly 50 is driven by the driving member 60 to rotate, thereby driving the pushing member 40 to move the equipment 80. The guide assembly 70 is mounted to a bottom of the equipment 80. The guide assembly 70 guides the equipment 80 when the equipment is being moved.

The transmission assembly 50 includes a synchronous gear set 51, a transmission gear set 52, and a gear shaft set 53. The synchronous gear set 51 includes a first synchronous gear 511 and a second synchronous gear 512. The transmission gear set 52 includes a first transmission gear 521 and a second transmission gear 522. The gear shaft set 53 includes a first gear shaft 531 and a second gear shaft 532. An upper end of the base 10 defines a first groove 11, and the cover 20 defines a second groove 21. The first gear shaft 531 is rotationally received within the first groove 11. The first synchronous gear 511 and the first transmission gear 521 are each sleeved over the first gear shaft 531. The second synchronous gear 512 and the second transmission gear 522 are each sleeved over the second gear shaft 532. The second gear shaft 532 is rotationally received within the second groove 21 and extends through a side of the cover 20. The driving member 60 is mounted to an end of the second gear shaft 532 extending out of the cover 20 and is substantially perpendicular to the second gear shaft 532. The driving member 60 includes a rotating handle 61 at an end of the driving member 60 away from the second gear shaft 532. A user may manually crank the driving member 60 by grasping the rotating handle 61 to operate the driving member 60. When the cover 20 is closed, the first synchronous gear 511 meshes with the second synchronous gear 512, and the outer surface of the driving member 40 meshes with gear teeth of the first transmission gear 521 and the second transmission gear 522.

The locking assembly 30 includes a first fastener 31 and a second fastener 32. The first fastener 31 is mounted to the base 10, and the second fastener 32 is mounted to the cover 20. The first fastener 31 is substantially a hook fastener. The second fastener 32 includes a U-shaped fastening ring 321 and a manual latch 322. The manual latch 322 drives the fastening ring 321 to move up and down. To lock the cover 20 to the base 10, the cover 20 is closed over the base 10 and the fastening ring 321 is sleeved over the first fastener 31. Then, the manual latch 322 is lifted up to latch the fastening ring 321. The first fastener 31 is hooked onto a bottom of the fastening ring 321 to lock the cover 20 to the base 10. To unlock the cover 20, the manual latch 322 is moved down to move the fastening ring 321 away from the first fastener 31, thereby unlocking the cover 20 from the base 10. In one embodiment, the locking assembly 30 is mounted to a front side and a back side of the base 10 and the cover 20.

The pushing member 40 is received within a screw hole of the equipment 80. Each guide assembly 70 includes a guide wheel 71 and a guide rail 72. The guide wheel 71 is mounted to a bottom of the equipment 80, and the guide rail 72 is mounted to a rotating floor 91 of the container 90. The rotating floor 91 is rotationally coupled to a bottom of the container 90. The rotating floor 91 is rotated away from the container 90 to position the guide rail 72 and support the equipment 80. The base 10 includes a fixing portion 12 extending from a central bottom portion of the base 10. The fixing portion 12 mounts the base 10 to the rotating floor 91.

When the equipment 80 needs to be moved out of the container 90, a user rotates the driving member 60 to rotate the second gear shaft 532. The second synchronous gear 512 and the second transmission gear 522 rotate with the second gear shaft 532. The first synchronous gear 511 is driven by the second synchronous gear 512 to rotate the first gear shaft 531 and the second transmission gear 522. The pushing member 40 meshed with the first transmission gear 521 and the second transmission gear 522 is driven to rotate by the first transmission gear 521 and the second transmission gear 522 to drive the equipment 80 to move out of the container 90. It should be understood that by rotating the driving member 60 in an opposite direction, the driving member 60 is moved in the opposite direction to drive the equipment 80 to move into the container 90.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An equipment moving device for moving a piece of equipment in and out of a container, the equipment moving device comprising:

a base;

a cover rotationally coupled to the base at an end of the cover and an end of the base;

a driving member mounted to an outer side of the cover;

a transmission assembly mounted within the base and the cover and coupled to the driving member, transmission assembly comprising a transmission gear set and a gear shaft set, the gear shaft set coupled to the driving member, the transmission gear set comprising a first transmission gear and a second transmission gear, the gear shaft set comprising a first gear shaft and a second gear shaft, the first gear shaft coupled to the first transmission gear, and the second gear shaft coupled to the second transmission gear; and a pushing member, one end of the pushing member coupled to the transmission assembly, and another end of the pushing member mounted to the piece of equipment;

wherein the driving member causes the transmission assembly to drive the pushing member to move the piece of equipment, the driving member causes the gear shaft set to drive the transmission gear set to rotate, the transmission gear set drives the pushing member to move, the pushing member is coupled to the first transmission gear and the second transmission gear, the first gear shaft is rotationally received within the base, and the second gear shaft is rotationally received within the cover, the driving member is coupled to the second gear shaft.

2. The equipment moving device of claim 1, wherein:

the transmission assembly comprises a synchronous gear set;

the synchronous gear set comprises a first synchronous gear and a second synchronous gear;

the first synchronous gear is mounted on the first gear shaft, and the second synchronous gear is mounted on the second gear shaft and engaged with the first synchronous gear;

the driving member causes the second gear shaft and the synchronous gear set to drive the first gear shaft to rotate.

3. The equipment moving device of claim 2, wherein:

an outer surface of the pushing member comprises a plurality screw threads or gear teeth; and the transmission gear set drives the pushing member to move by engaging with the screw threads or gear teeth.

4. The equipment moving device of claim 3, wherein the driving member is perpendicularly mounted to the second gear shaft.

5. The equipment moving device of claim 1, further comprising a locking assembly adapted to lock the base to the cover.

6. The equipment moving device of claim 5, wherein:

the locking assembly comprises a first fastener and a second fastener;

the first fastener is mounted to the base, and the second fastener is mounted to the cover;

when the first fastener and the second fastener are fastened together, the cover is locked to the base.

7. The equipment moving device of claim 1, wherein the base comprises a fixing portion extending from a bottom side of the base, the fixing portion mounts the base to the container.

8. The equipment moving device of claim 1, further comprising a guide assembly, the guide assembly comprising:

a guide rail mounted to the container; and a guide wheel mounted to a bottom of the piece of equipment and rollably mounted to the guide rail.

9. A container comprising:

a rotating floor rotationally coupled to a bottom of the container and supporting pieces of equipment in the container; and an equipment moving device adapted to move the pieces of equipment in and out of the container, the equipment moving device comprising:

a base;

a cover rotationally coupled to the base at an end of the cover and an end of the base;

a driving member mounted to an outer side of the cover;

a transmission assembly mounted within the base and the cover and coupled to the driving member; and a pushing member, one end of the pushing member coupled to the transmission assembly, and another end of the pushing member mounted to the pieces of equipment;

wherein the driving member causes the transmission assembly to drive the pushing member to move the pieces of equipment.

10. The container of claim 9, wherein:

the transmission assembly comprises a transmission gear set and a gear shaft set, the transmission gear set sleeved over the gear shaft set;

the gear shaft set is coupled to the driving member;

the driving member causes the gear shaft set to drive the transmission gear set to rotate; and the transmission gear set drives the pushing member to move.

11. The container of claim 10, wherein:

the transmission gear set comprises a first transmission gear and a second transmission gear;

the pushing member is coupled to the first transmission gear and the second transmission gear;

the gear shaft set comprises a first gear shaft and a second gear shaft, the first gear shaft coupled to the first transmission gear, and the second gear shaft coupled to the second transmission gear;

the first gear shaft is rotationally received within the base, and the second gear shaft is rotationally received with the cover;

the driving member is coupled to the second gear shaft.

12. The container of claim 11, wherein:

the transmission assembly comprises a synchronous gear set;

the synchronous gear set comprises a first synchronous gear and a second synchronous gear;

the first synchronous gear is mounted on the first gear shaft, and the second synchronous gear is mounted on the second gear shaft;

the driving member causes the second gear shaft and the synchronous gear set to drive the first gear shaft to rotate.

13. The container of claim 12, wherein:

an outer surface of the pushing member comprises a plurality screw threads or gear teeth; and the transmission gear set drives the pushing member to move by engaging with the screw threads or gear teeth.

14. The container of claim 13, wherein the driving member is perpendicularly mounted to the second gear shaft.

15. The container of claim 9, further comprising a locking assembly adapted to lock the base to the cover.

16. The container of claim 15, wherein:

the locking assembly comprises a first fastener and a second fastener;

the first fastener is mounted to the base, and the second fastener is mounted to the cover;

when the first fastener and the second fastener are fastened together, the cover is locked to the base.

17. The container of claim 9, wherein the base comprises a fixing portion extending from a bottom side of the base, the fixing portion mounts the base to the container.

18. The container of claim 9, further comprising a guide assembly, the guide assembly comprising:

a guide rail mounted to the rotating floor of the container; and a guide wheel adapted to be mounted to a bottom of the equipment and rollably mounted to the guide rail.

* * * * *